US005394929A

United States Patent [19]

Pyzik et al.

[11] Patent Number: 5,394,929

[45] Date of Patent: Mar. 7, 1995

[54] METHOD OF PREPARING BORON CARBIE/ALUMINUM CERMETS HAVING A CONTROLLED MICROSTRUCTURE

[75] Inventors: Aleksander J. Pyzik, Midland; Jack J. Ott, Hemlock; Dniel F. Carroll; Arthur R. Prunier, Jr., both of Midland, all of Mich.

[73] Assignee: The Dow Chemical Company, Midland, Mich.

[21] Appl. No.: 154,904

[22] Filed: Nov. 19, 1993

Related U.S. Application Data

[63] Continuation-in-part of Ser. No. 916,041, Jul. 17, 1992, abandoned.

[51] Int. Cl.[6] ..... B22D 19/14

[52] U.S. Cl. ..... 164/97; 164/103

[58] Field of Search ..... 164/91, 97, 98, 100, 164/102, 101, 103, 105

[56] References Cited

U.S. PATENT DOCUMENTS

| | | | |
|---|---|---|---|
| 3,796,564 | 3/1974 | Taylor | 75/238 |
| 3,864,154 | 2/1975 | Gazza | 264/60 |
| 4,605,440 | 8/1986 | Halverson et al. | 75/238 |
| 4,702,770 | 10/1987 | Pyzik et al. | 75/236 |
| 4,718,941 | 1/1988 | Halverson et al. | 75/236 |
| 4,834,938 | 5/1989 | Pyzik et al. | 419/6 |
| 4,961,778 | 10/1990 | Pyzik et al. | 75/230 |
| 5,039,633 | 8/1991 | Pyzik et al. | 501/93 |
| 5,145,504 | 9/1992 | Pyzik | 75/230 |

OTHER PUBLICATIONS

U.S. patent application Ser. No. 07/736,991 Filed Jul. 29, 1991.

U.S. patent application Ser. No. 07/671,580 Filed Mar. 19, 1991.

U.S. patent application Ser. No. 07/672,259 Filed Mar. 20, 1991.

U.S. patent application Ser. No. 7/789,380 Filed Nov. 6, 1991.

D. Briggs, M. P. Seah, "*Practical Surface Analysis*", John Wiley and Sons, New York 1983, pp. 6–8.

Joachim Stohr "*NEXAFS Spectroscopy*", *Springer–Verlag, Berlin Heidelberg, 1992, pp. 4–8.*

*Primary Examiner*—P. Austin Bradley
*Assistant Examiner*—Erik R. Puknys
*Attorney, Agent, or Firm*—Dan R. Howard

[57] ABSTRACT

The invention relates to subjecting boron carbide to a heat treatment at a temperature within a range of 1250° C. to less than 1800° C. prior to infiltration with a molten metal such as aluminum. This method allows control of kinetics of metal infiltration and chemical reactions, size of reaction products and connectivity of $B_4C$ grains and results in cermets having desired mechanical properties.

8 Claims, No Drawings

METHOD OF PREPARING BORON CARBIE/ALUMINUM CERMETS HAVING A CONTROLLED MICROSTRUCTURE

CROSS-REFERENCE TO RELATED APPLICATIONS

This application is a continuation-in-part of application Ser. No. 07/916,041 filed Jul. 17, 1992 and now abandoned.

BACKGROUND OF THE INVENTION

The United States Government has rights to this invention pursuant to Contract Number N-66857-91-C-1034 awarded by Navy Ocean Systems Center, San Diego, Calif.

This invention relates generally to boron carbide/aluminum ($B_4C/Al$) cermets and their preparation. This invention relates more particularly to $B_4C/Al$ cermets having improved properties through a controlled microstructure and their preparation.

U.S. Pat. No. 4,605,440 discloses a process for preparing $B_4C/Al$ composites that includes a step of heating a powdered admixture of aluminum and boron carbide at a temperature of 1050° C. to 1200° C. The process yields, however, a mixture of several ceramic phases that differ from the starting materials. These phases, which include $AlB_2$, $Al_4BC$, $AlB_{12}C_2$, $AlB_{12}$ and $Al_4C_3$, adversely affect some mechanical properties of the resultant composite. In addition, it is very difficult to produce composites having a density greater than 99% of theoretical by this process. This may be due, in part, to reaction kinetics that lead to formation of the ceramic phases and interfere with the rearrangement needed to attain adequate shrinkage or densification. It may also be due, at least in part, to the lack of control over reactivity of molten aluminum. In fact, most of the aluminum is depleted due to formation of the reaction products.

U.S. Pat. No. 4,702,770 discloses a method of making a $B_4C/Al$ composite. The method includes a preliminary step wherein particulate $B_4C$ is heated in the presence of free carbon at temperatures ranging from 1800° C. to 2250° C. to provide a carbon enriched $B_4C$ surface having a reactivity with molten aluminum that is lower than a $B_4C$ surface without carbon enrichment. The reduced reactivity minimizes the undesirable ceramic phases formed by the process disclosed in U.S. Pat. No. 4,605,440. During heat treatment, the $B_4C$ particles form a rigid network. The network, subsequent to infiltration by molten aluminum, substantially determines mechanical properties of the resultant composite. At temperatures in excess of 2000° C., carbon distribution tends to be variable which leads, in turn, to different rates and degrees of sintering. The latter differences may result in cracking of parts having a thickness of 0.5 inch (1.3 cm) or greater.

U.S. Pat. No. 4,718,941 discloses a method of making metal-ceramic composites from ceramic precursor starting constituents. The constituents are chemically pretreated, formed into a porous precursor and then infiltrated with molten reactive metal. The chemical pretreatment alters the surface chemistry of the starting constituents and enhances infiltration by the molten metal. Ceramic precursor grains, such as boron carbide particles, that are held together by multiphase reaction products formed during infiltration form a rigid network that substantially determines mechanical properties of the resultant composite. A potential shortcoming of this method is that one cannot control the amount and size of phases that make up the multiphase reaction products.

SUMMARY OF THE INVENTION

A first aspect of the present invention is a method for making a boron carbide/aluminum composite comprising sequential steps: a) heating a porous boron carbide preform in an environment that is devoid of added free carbon to a temperature within a range of from 1250° C. to less than 1800° C. for a period of time sufficient to reduce reactivity of the boron carbide with molten aluminum; and b) infiltrating molten aluminum into the heated boron carbide preform, thereby forming a boron carbide/aluminum composite.

As used herein the phrase "an environment that is devoid of added free carbon" means that neither solid sources of carbon such as graphite nor gaseous sources of carbon such as a hydrocarbon are deliberately placed in contact with the $B_4C$ preform during heat treatment. Those skilled in the art recognize that very small amounts of carbon monoxide are inherently present in some furnaces, such as a graphite furnace. They also recognize that use of a different type of furnace, such as one heated by a tungsten or a molybdenum heating elements effectively eliminates carbon monoxide. The small amounts of carbon monoxide are not, however, of concern as results are believed to be independent of the type of furnace and the presence or absence of small amounts of carbon monoxide. In other words, no attempt is made to enrich the carbon content of the $B_4C$. Stated differently, the only carbon that is in contact with the preform is that which is inherently present in $B_4C$ powders.

The method is based upon reduction of reactive boron in the $B_4C$. It is believed that the reactive boron is largely responsible for chemical reactions that lead to metal depletion. The method allows control of three features of the resultant $B_4C/Al$ composites. The features are: amount of reaction phases; size of reaction phase grains or clusters; and degree of connectivity between adjacent $B_4C$ grains. The method also allows one to prepare different types of microstructures. In a first type, aluminum is almost completely reacted and $B_4C$ grains are separated from each other. A second type, also known as a transition microstructure, has a lesser degree of reaction than the first type but a similar degree of separation between $B_4C$ grains. A third type has a lesser degree of reaction than the second type, but a discernible amount of connectivity between $B_4C$ grains.

A second aspect of the present invention includes $B_4C/Al$ composites formed by the process of the first aspect. The $B_4C/Al$ composites are characterized by a combination of a compressive strength greater than or equal to about 3 GPa, a fracture toughness $\geqq$ about 6 $MPa \cdot m^{\frac{1}{2}}$, a flexure strength $\geqq$ about 600 MPa, a hardness greater than or equal to 1400 $kg/mm^2$ and a density $\leqq$2.65 grams per cubic centimeter (g/cc). These composites are formed from $B_4C$ that has been heat treated at a temperature of from 1250° C. to less than 1350° C.

A third aspect of the present invention includes $B_4C/Al$ composites formed by the process of the first aspect but with $B_4C$ that is heat treated at a greater temperature than the $B_4C$ used in preparing the composites of the second aspect. The temperature is from 1350° C. to less than 1800° C. The composites are characterized by a combination of a compressive strength greater than or equal to about 3 GPa, a fracture toughness of greater than about 6 MPa·m$^{\frac{1}{2}}$, a flexure strength that is greater than about 600 MPa, a hardness that is within a range of from about 600 to about 800 kg/mm$^2$ and a density ≦2.65 g/cc. The actual properties vary with $B_4C$ content as well as the heat treatment temperature. The foregoing properties are readily attainable with a $B_4C$ content of 70 or 75 percent by volume, based upon total composite volume. If the $B_4C$ content decreases to 55 percent by volume, certain properties, particularly fracture toughness, tend to increase over that attainable with a $B_4C$ content of 70 percent by volume.

The composites are suitable for use in applications requiring light weighty high flexure strength and an ability to maintain structural integrity in a high compressive pressure environment. Automobile and aircraft brake pads are one such application.

DETAILED DESCRIPTION

Boron carbide, a ceramic material characterized by high hardness and superior wear resistance, is a preferred material for use in the process of the present invention.

Aluminum (Al), a metal used in ceramic-metal composites, or cermets, to impart toughness or ductility to the ceramic material is a second preferred material. The Al may either be substantially pure or be a metallic alloy having an aluminum content of greater than 80 percent by weight (wt. %), based upon alloy weight.

The process aspect of the invention begins with heating a porous body preform or greenware article. The preform is prepared from $B_4C$ powder by conventional procedures. These procedures include slip casting a dispersion of the ceramic powder in a liquid or applying pressure to powder in the absence of heat. Although any $B_4C$ powder may be used, the $B_4C$ powder desirably has a particle diameter within a range of 0.1 to 5 micrometers (μm). Ceramic materials in the form of platelets or whiskers may also be used.

The porous $B_4C$ preform is heated to a temperature within a range of from about 1250° C. to less than 1800° C. The preform is maintained at about that temperature for a period of time sufficient to reduce reactivity of the $B_4C$ with molten Al. The time is suitably within a range of from about 5 minutes to about 5 hours. Heating times in excess of 5 hours are uneconomical as they do not provide any substantial increase in physical properties of cermets or composites prepared from the preforms. The range is preferably from about 30 minutes to about 2 hours.

When $B_4C$ is heated to temperatures above 1250° C. but less than 1800° C., changes in reactivity between Al and $B_4C$ are observed. The changes are visible in optical and scanning electron micrographs of polished samples of resulting $B_4C$/Al cermets. High temperature differential scanning calorimetry (DSC) can be used to determine unreacted-aluminum metal contents. As the heating temperature increases from about 1300° C. to about 1400° C., an increase in amount of unreacted aluminum occurs concurrent with a rapid reduction in chemical reaction kinetics. At temperatures of from greater than about 1400° C. to less than 1800° C., the amount of unreacted aluminum remains relatively constant. The amount typically ranges from about 47 to about 83% of total introduced aluminum depending upon surface area and type of $B_4C$ powder. As temperatures increase within a range of from greater than 1800° C. to less than about 2000° C., a gradual further reduction of chemical reaction kinetics occurs. At temperatures in excess of 2000° C., the reduction becomes more pronounced.

As $B_4C$ is subjected to heat treatment, $B_4C$ surface carbon contents, as determined by x-ray photoelectron spectroscopy (XPS) at room temperature subsequent to heat treatment, remain relatively constant up to about 1900° C. D. Briggs et al., ed., in *Practical Surface Analysis by Auger and X-ray Photoelectron Spectroscopy*, John Wiley and Sons (New York, 1983), provide a general introduction to XPS at pages 6–8 and a more detailed explanation of XPS in sections 3.4, 5.3 and 5.4 and in chapter 9. The relevant teachings of D. Briggs et al. are incorporated herein by reference. XPS collects emitted electrons from a sample at a depth of 60 to 70 Å (6-7 nm). At temperatures in excess of 1900° C., the $B_4C$ surface carbon content increases rapidly. It is not known whether the increase is due to diffusion of carbon from within a $B_4C$ grain to its surface or to migration from surfaces within a heat treatment furnace. Irrespective of the source, increases in graphitic carbon content with increasing temperature do occur.

U.S. Pat. No. 4,702,770 teaches that particulate $B_4C$ should be heated in the presence of free carbon to 1800° C.–2250° C. to reduce reactivity of the $B_4C$ with Al. It is believed that when excess carbon is present during heat treatment at temperatures below 1800° C., the carbon does not react with the $B_4C$ to modify its surface, but remains as free carbon. When contacted with molten aluminum during infiltration, the free carbon reacts with Al to form $Al_4C_3$, a very undesirable reaction product.

In accordance with the present invention, heat treatment is conducted in the absence of free carbon. This produces preforms that are cleaner and less susceptible to $Al_4C_3$ formation than would be the case if heat treatment were conducted at the same temperatures in the presence of free carbon.

Although $B_4C$ surface carbon contents remain virtually constant with heat treatments in accordance with the present invention at temperatures of from 1250° C. to less than 1800° C., XPS characterization techniques show that $B_4C$ surface boron contents do not. As the heat treatment temperature increases from about 1300° C. to about 1400° C., the surface boron content decreases sharply. As the heat treatment temperature continues to increase to about 1600° C., surface boron content remains essentially constant. A gradual decline in surface boron content occurs as the heat treatment temperature increases from 1600° C. to less than 1800° C. An even more gradual decline occurs as heat treatment temperatures increase to about 2000° C.

It has been discovered, via near edge x-ray absorption fine structure (NEXAFS) methodology, that two different forms of surface boron are present, particularly in preforms that are subjected to heat treatment temperatures within a range of 1250° C. to 1400° C. One form, designated as $B_3'$, is more reactive than the other, designated as $B_3$. At heat treatment temperatures in excess of 1400° C., $B_3'$ content is at or near zero and any surface boron is substantially in the $B_3$ form. NEXAFS is described by Joachim Stohr in *NEXAFS Spectroscopy*, Springer-Verlag, Berlin (1992), at pages 4–8 and chapters 4 and 5 and by F. Brown et al., in *Physical Review* Bulletin, volume 13 at page 2633 (1976). The relevant teachings of these references are incorporated herein by reference.

NEXAFS allows measurement of the absorption of x-rays as a function of energy. Either emitted x-rays (fluorescence yield or FY) or emitted electrons (EY) produce signals that are proportional to absorption strength. EY and FY are detected simultaneously. FY gives information about bulk characteristics due to the long mean free path (about 50 to 2000 Å or 5 to 200 nm) of x-rays in the material. EY gives information related to surface species (about 30 Å (3 nm)) due to the short mean free path of electrons.

Analysis of bulk x-ray diffraction patterns does not show any difference in boron carbide structure as a result of heat treatment temperature. This analysis agrees with the B-C phase diagram that is constructed based upon bulk chemistry data and predicts no changes below 2000° C. FY spectra are believed to be bulk sensitive since signals are gathered from a depth of several hundred angstroms in the case of carbon and as much as 2000 Å (200 nm) in the case of boron. As such, signals arising within the first few angstroms of the surface of a sample are believed to be overwhelmed by the signals coming from deeper in the sample.

As temperatures increase from 1250° C. to less than 1800° C., the microstructure of the resultant cermet changes. At a temperature of from 1250° C. to less than about 1350° C., the microstructure undergoes rapid changes. In other words, temperatures of 1250° C. to 1350° C. constitute a transition zone. At one end, near 1250° C., the microstructures resemble the microstructure resulting from the use of untreated boron carbide. At the other end, near 1350° C., chemical reactions between $B_4C$ and Al are noticeably slower than at 1250° C. The microstructure is characterized by a discontinuous $B_4C$ phase surrounded by clusters of reaction products. The reaction products are present in an amount that is from about 3 to about 10 percent by volume less than the amount of reaction products present in a composite prepared from a substantially identical, but unheated porous $B_4C$ preform.

Even though the microstructures of $B_4C$/Al cermets that result from porous $B_4C$ preforms that are heat-treated at temperatures of 1250° C. to 1350° C. may resemble those resulting from the use of $B_4C$ that is chemically treated, molten aluminum penetrates into the former more rapidly than the latter. This promotes production of larger parts. Heat treatment at 1200° C. or below provides no benefit. Heat treatment above 1250° C., particularly from 1250° C. to less than 1350° C., imparts a mechanical strength to the porous preforms that allows them to be machined prior to infiltration. This eliminates the need for a binder to provide sufficient strength for machining green preforms prior to heat treatment. The absence of any binder also means there is no binder residue, such as free carbon, that will produce unwanted reaction products such as $Al_4C_3$ during infiltration with molten aluminum. $B_4C$/Al cermets produced from $B_4C$ that is heat treated at temperatures of 1250° C. to 1350° C. have, in comparison to cermets prepared from chemically treated $B_4C$, a similar hardness but a greater strength and toughness.

At temperatures within a range of from 1350° C. to less than 1450° C., the cermets have a microstructure characterized by a continuous metal phase and a discontinuous $B_4C$ phase. The cermets or composites have an aluminum phase content of more than about 10 wt. %, based upon total composite weight.

At temperatures within a range of from 1450° C., but less than about 1600° C., the microstructure is characterized by $B_4C$ grains that are isolated or weakly bonded to adjacent grains and surrounded by aluminum metal. Temperatures near 1450° C. typically yield the isolated grains whereas temperatures near 1600° C. usually result in weakly bonded boron carbide grains. Composites having this type of microstructure have a greater metal content than composites prepared from $B_4C$ that has been formed into a porous precursor without any prior heat treatment. Microstructures of cermets that result from heat-treatment within this temperature range are unique if the $B_4C$ has a size of less than about 10 μm. The unique microstructure leads to improvements in fracture toughness and flexure strength over cermets prepared from $B_4C$ that is heat treated below 1250° C.

At temperatures within a range of from 1600° C. to less than 1800° C., the composite has a microstructure characterized by a partially continuous $B_4C$ skeleton with uniformly distributed $Al_4BC$ reaction products and aluminum metal. The $Al_4BC$ reaction products are in the form of elongated cigar-shaped clusters.

Heat treatments change chemical reactivity between $B_4C$ and Al and affect the grain size of, or volume occupied by, reaction products or phases that result from reactions between $B_4C$ and Al. In the absence of a heat treatment or with a heat treatment at a temperature below 1250° C., comparatively large clusters of $AlB_2$ and $Al_4BC$ form. Although $B_4C$ grains have an average size of about 3 μm, an average cluster of $AlB_2$ or $Al_4BC$ may reach 50 to 100 μm. Clusters of grains consisting of one phase (such as $Al_4BC$) are believed to have grain boundaries with clusters of grains consisting of another phase (such as $AlB_2$) that are free of Al metal. In this manner, a continuous network of connected large ceramic clusters is believed to form. Large clusters of grains of $Al_4BC$ are particularly detrimental because $Al_4BC$ is more brittle than $B_4C$ or Al. Large grains also affect fracture behavior and contribute to low strength (less than 45 ksi (310 MPa)) and low fracture toughness ($K_{IC}$ values of less than 5 MPa·m$^{\frac{1}{2}}$). Heat treatments at 1300° C. for longer than one hour, preferably at least two hours, lead to reductions in $Al_4BC$ grain size to less than 5 μm, frequently less than 3 μm. Concurrent with the grain size reductions, the strength and toughness increase. The reduced grain size and increased strength (from about 600 to about 700 MPa) and toughness (from 6 to about 8 MPa·m$^{\frac{1}{2}}$) can be maintained with heat treatment temperatures as high as 1400° C. provided treatment times do not exceed five hours. The heating time at 1400° C. is beneficially less than two hours, desirably from about five minutes to about two hours and preferably from about 0.5 hour to about two hours. As temperatures increase above 1400° C. or treatment times at 1400° C. exceed five hours, $Al_4BC$ grains tend to grow and form form elongated, cigar-shaped grains having an average diameter of 3–8 μm and a length of 10–25 μm. The size of $Al_4BC$ "cigars" increases as temperature increases up to a maximum at a temperature of about 1750° C. to 1800° C. The elongated $Al_4BC$ grains or "cigars" tend to be surrounded by Al metal and are believed to act as an in-situ reinforcement as cermets produced from $B_4C$ that is heat treated at temperatures of from 1700° C. to less than 1800° C. tend to have higher fracture toughness values than cermets prepared from $B_4C$ that is subjected to other heat treatment temperatures. At temperatures above 1800° C., larger clusters, similar to those observed with heat treatment at temperatures below 1250° C., begin to form.

The heat treatment does not require the presence of carbon. In fact, carbon is an undesirable component as it leads to an increase in $Al_4C_3$ when it is present. $Al_4C_3$ is believed to be an undesirable phase because it hydrolyzes readily in the presence of normal atmospheric humidity. Accordingly, the $Al_4C_3$ content is beneficially less than 1% by weight, based upon composite weight, preferably less than 0.1% by weight.

Composite physical properties are also affected by $B_4C$ content. As the volume percent of $B_4C$ decreases from about 75 volume percent to about 55 volume percent, based upon total composite volume, toughness increases from about 6 to about 12 $MPa \cdot m^{\frac{1}{2}}$.

Infiltration of a preform that is heated to a temperature of greater than 1250° C. to less than 1800° C. occurs faster than in an unheated preform. In addition, the heat treated preform is easier to handle than the unheated preform and may even be machined prior to infiltration.

Infiltration of molten aluminum into heat-treated porous preforms is suitably accomplished by conventional procedures such as vacuum infiltration or pressure-assisted infiltration. Although vacuum infiltration is preferred, any technique that produces a dense cermet body may be used. Infiltration preferably occurs below 1200° C. as infiltration at or above 1200° C. leads to formation of large quantities of $Al_4C_3$.

A primary benefit of heat treatments at a temperature of from about 1250° C. to less than 1800° C., is an ability to control the microstructure of resulting $B_4C/Al$ cermets. Factors contributing to control include variations in (a) amounts and sizes of resultant reaction products or phases, (b) connectivity between adjacent $B_4C$ grains, and (c) amount of unreacted aluminum. Control of the microstructure leads, in turn, to control of physical properties of the cermets. This is in contrast to infiltration of green $B_4C$ preforms, a technique that does not provide control over the amount and morphology of reaction phases. It is also in contrast to infiltration of $B_4C$ that is sintered at temperatures above 1800° C. The latter technique provides no more than limited control over $B_4C$ network connectivity and does not allow one to control morphology of reaction phases. One can therefore produce near-net shape parts with improved mechanical properties without sintering $B_4C$ preforms at temperatures above 1800° C. prior to infiltration. The production of near-net shapes below 1800° C. eliminates problems such as warping and cracking of preforms at high temperatures and costly shaping operations subsequent to preparation of the cermets. Unique combinations of properties may also result, such as high compressive strength ($\geqq$3 GPa), high flexure strength ($\geqq$600 MPa) and fracture toughness ($\geqq$6 $MPa \cdot m^{\frac{1}{2}}$) in conjunction with low theoretical density ($\leqq$2.65 g/cc). Cermet materials prepared from heat treated $B_4C$ in accordance with the present invention are believed to have higher strength and toughness than those prepared from $B_4C$ that is not subjected to such heat treatments. In addition, they are believed to have higher strength, toughness and hardness than cermets prepared from $B_4C$ that is sintered at temperatures above 1800° C. when such cermets are compared on the basis of the same initial $B_4C$ content.

The following examples further define, but are not intended to limit the scope of the invention. Unless otherwise stated, all parts and percentages are by weight.

EXAMPLE 1

$B_4C$ (ESK specification 1500, manufactured by Elektroschmelzwerk Kempten of Munich, Germany, and having an average particulate size of 3 μm) powder was dispersed in distilled water to form a suspension. The suspension was ultrasonically agitated, then adjusted to a pH of 7 by addition of $NH_4OH$ and aged for 180 minutes before being cast on a plaster of Paris mold to form a porous ceramic body (greenware) having a ceramic content of 69 volume percent. The $B_4C$ greenware was dried for 24 hours at 105° C.

Several pieces of greenware were baked at temperatures of 1300° C. to 1750° C. for 30 minutes in a graphite element furnace. The baked greenware pieces were then infiltrated with molten aluminum (a specification 1145 alloy, manufactured by Aluminum Company of America that is a commercial grade of aluminum, comprising less than 0.55 percent alloying elements such as Si, Fe, Cu and Mn) with a vacuum of 100 millitorr (13.3 Pa) at 1180° C. for 105 minutes.

Chemical analysis of the alloyed cermet body was completed using an MBX-CAMECA microprobe, available from Cameca Co., France. Crystalline phases were identified by X-ray diffraction with a Phillips diffractometer using CuKα radiation and a scan rate of 2° per minute. The amount of aluminum metal present in the infiltrated greenware was determined by differential scanning calorimetry. The phase chemistry of infiltrated samples using greenware baked at 1300° C., 1600° C. and 1750° C. is shown in Table I. Composites or cermets prepared from unbaked greenware contain greater amounts of $AlB_2$ and $Al_4BC$ and lesser amounts of Al and $B_4C$ than those prepared from greenware baked at 1300° C.

TABLE I

| Baking Temp. °C. | Phase Chemistry Volume Percentage* | | | | |
|---|---|---|---|---|---|
| | $AlB_2$ | $Al_4BC$ | Al | $B_4C$** | $Al_4C_3$ |
| 1300 | 17.0 | 18.6 | 3.6 | 60.8 | 0 |
| 1600 | 2.4 | 4.7 | 26.9 | 66.0 | Trace |
| 1750 | 4.6 | 4.1 | 23.9 | 66.4 | ~1 |

*Chemical constituents normalized to 100 after void volume is removed.
**Represents a mixture of $B_4C$ and $AlB_{24}C_4$ The flexure strengths were measured by the four-point bend test (ASTM C1161) at ambient temperatures using a specimen size of 3×4×45 mm. The upper and lower span dimensions were 20 and 40 mm, respectively. The specimens were broken using a crosshead speed of 0.5 mm/min.

Thee broken pieces from the four-point bend test were used to measure density using an apparatus designated as an Autopycnometer 1320 (commercially available from Micromeritics Corp.).

The bulk hardness was measured on surfaces polished successively with 45, 30, 15, 6 and 1 μm diamond pastes and then finished with a colloidal silica suspension using a LECO automatic polisher.

Fracture toughness was measured using the Chevron notched bend beam technique with samples measuring 4×3×45 mm. The notch was produced with a 250 μm wide diamond blade. The notch depth to sample height ratio was 0.42. The notched specimens were fractured in 3-point bending using a displacement rate of 1 μm/minute.

The results of physical property testing are shown in Table II. Table II also shows aluminum metal content and baking temperature.

TABLE II

| Baking Temp. °C. | Al Metal (Wt %) | Hardness ($kg/mm^2$) | Density (g/cc) | Flexure Strength (MPa) | Fracture Toughness ($K_{IC}$) ($Mpa \cdot m^{\frac{1}{2}}$) |
|---|---|---|---|---|---|
| 1300 | 7.0 | 1071 | 2.61 | 469 | 5.1 |
| 1600 | 25.0 | 705 | 2.57 | 552 | 6.9 |
| 1750 | 23.9 | 625 | 2.57 | 524 | 7.0 |

Examination of the samples via optical microscopy revealed the presence of some flaws or inclusions. The flaws appeared to be agglomerates of $B_4C$ that were not filled with metal. Three additional samples were prepared by a modified procedure and tested for flexure strength. The modified procedure involved placing the suspension components in a jar with $B_4C$ milling media and then mixing the components by rolling the jar for about 18 hours on a roll mill apparatus. Samples baked at temperatures of 1300° C., 1600° C. and 1750° C. had respective flexure strengths of 602 MPa, 617 MPa and 605 MPa. Examination of the latter samples revealed none of the flaws present in the earlier samples. Testing for hardness and fracture toughness was not done as these properties were believed to be less sensitive than flexure strength to the influence of localized flaws.

The data presented in Tables I and II and in the modified procedure demonstrate three points. First, the temperature at which the greenware is baked has a marked influence upon the phase chemistry of the resultant $B_4C/Al$ cermets. Composites or cermets prepared from unbaked greenware contain greater amounts of $AlB_2$ and $Al_4BC$ and lesser amounts of Al and $B_4C$ than those prepared from greenware baked at 1300° C. As the baking temperature increases above 1400° C., the amount of unreacted or retained aluminum metal is substantially greater than the amount in the cermet made from unbaked greenware or greenware baked at 1300° C. Similarly, the volume percentage of reaction products $AlB_2$ and $Al_4BC$ also goes down as the bake temperature increases. Second, the data demonstrate that one can now control both cermet microstructure and physical properties based upon the temperature at which the greenware is baked. Third, the degree of mixing has a beneficial effect upon part consistency and uniformity as well as upon flexure strength.

EXAMPLE 2

Ceramic greenware pieces were prepared by replicating the procedure of Example 1. The pieces were baked for varying lengths of time at different temperatures. Infiltration of the baked pieces occurred as in Example 1. The baking times and temperatures and the flexure strengths of resultant cermets are shown in Table III. The flexure strengths of cermets prepared from greenware baked at less than 1250° C. are lower than those of composites prepared from greenware baked at 1300° C.

TABLE III

| Baking Temperature/ Baking Time | Flexure Strength (MPa) 0.5 Hr | 1 Hr | 2 Hrs | 5 Hrs |
|---|---|---|---|---|
| 1300° C. | 310 | 296 | 545 | 586 |
| 1400° C. | 552 | 648 | 634 | 593 |

TABLE III-continued

| Baking Temperature/ Baking Time | Flexure Strength (MPa) 0.5 Hr | 1 Hr | 2 Hrs | 5 Hrs |
|---|---|---|---|---|
| 1600° C. | 530 | 530 | 572 | 614 |

Duplication of the samples baked for 0.5 hour and 1 hour at 1300° C. using the modified procedure of Example 1 provided improved flexure strength values. The flexure strengths for 0.5 hour and 1 hour were, respectively, 510 MPa and 496 MPa.

The data presented in Table III show maxima in flexure strength with a baking temperature of 1400° C. and baking times of one and two hours. Although not as high as the maxima, the other values in Table III are quite satisfactory. The flexure strength values shown in Table III are believed to exceed those of $B_4C/Al$ cermets prepared by other procedures.

Samples prepared from cermets resulting from the heat treatment at 1300° C. were used to characterize fracture toughness ($K_{IC}$). The fracture toughness values, in terms of $MPa \cdot m^{\frac{1}{2}}$ were as follows: 5.6 at 0.5 hour; 5.8 at 1 hour; 6.4 at 2 hours and 6.9 at 5 hours.

Fracture toughness, like flexure strength, tends to increase with baking time for a baking temperature of 1300° C. The variations in both fracture toughness and flexure strength between the sample baked for 0.5 hour at 1300° C. in this Example and the sample baked for 0.5 hour at 1300° C. in Example 1 indicate that temperatures of 1250° C. to 1400° C. constitute a transition zone. Within such a zone, small variations in temperature, baking time or both can produce marked differences in physical properties of resultant cermets.

The cermets were subjected to analysis, as in Example 1, to determine the average size of the $Al_4BC$ clusters in μm. The data are shown in Table IV.

TABLE IV

| Baking Temperature/ Baking Time | Average $Al_4BC$ Size (length) (μm) 0.5 Hr | 1 Hr | 2 Hrs | 5 Hrs |
|---|---|---|---|---|
| 1300° C. | 50 | 40 | 5 | 3 |
| 1400° C. | 3 | 1 | 5 | 8 |
| 1600° C. | 10 | 10 | 20 | 25 |

The data show that both the size and morphology of the $Al_4BC$ clusters change as temperature increases. At 1300° C. and below, $Al_4BC$ grains have a tendency to form large patches of grain. However, at 1300° C., longer baking times of, for example, about two hours, can give smaller grains as shown in Table IV. Between about 1350° C. and about 1450° C., $Al_4BC$ grain size becomes smaller and the morphology is equiaxed. Above about 1450° C., $Al_4BC$ grains begin to increase in size again. In addition, the grains begin to form clusters again, this time with an aspect ratio greater than 5. The data also suggest that by varying the baking temperature, one can control the size of reaction products in addition to kinetics of the reactions that form such products.

EXAMPLE 3

Greenware pieces having a green density of 71% of theoretical density were prepared using the modified process disclosed in Example 1 from a 70:30 (weight ratio) mixture of the same $B_4C$ powder as in Example 1 and a second $B_4C$ powder (ESK specification 1500S, a blend of large and very small particles manufactured by Elektroschmelzwerk Kempten of Munich, Germany and having an average particulate size of 5 μm). The greenware pieces were baked at the temperatures shown in Table V. The baked pieces were converted to cermets as in Example 1 and measured for residual aluminum content, strength, toughness and hardness. All measured values are shown in Table V.

TABLE V

| Baking Temp. °C. | Flexure Strength (MPa) | Fracture Toughness ($K_{IC}$) (MPa · $m^{\frac{1}{2}}$) | Hardness ($kg/mm^2$) | Al Metal (Wt %) |
|---|---|---|---|---|
| 1200 | 560 | 5.1 | 1408 | 5.7 |
| 1300 | 634 | 5.4 | 1420 | 8.2 |
| 1475 | 662 | 6.2 | 825 | 14.4 |
| 1600 | 685 | 7.2 | 685 | 16.2 |
| 1800 | 680 | 7.5 | 698 | 18.7 |
| 1900 | 660 | 7.1 | 663 | 20.2 |
| 2000 | 590 | 5.9 | 720 | 21.2 |
| 2200 | 545 | 5.2 | 735 | — |

— means not measured

The data presented in Table V show that, notwithstanding some differences based upon source of $B_4C$, trends remain the same. For example, heat treatment temperatures between 1300° C. and 1800° C. produce maxima in toughness and strength for a given volume percent of $B_4C$. Heat treatment temperatures between about 1250° C. and 1300° C. provide cermets that, when compared to cermets prepared from $B_4C$ that has not been heat treated, have comparable hardness values but increased toughness and strength. Heat treatment temperatures between 1300° C. and 1800° C. provide cermets that, when compared to cermets prepared from $B_4C$ that has been heat treated at temperatures in excess of 1800° C., have comparable hardness values but increased toughness and strength.

EXAMPLE 4

Cermets were prepared as in Example 1 save for varying the volume percentage, based upon theoretical, of $B_4C$ in the greenware and baking all greenware at 1400° C. for 30 minutes prior to infiltration. The volume percentages and toughness values for the resultant cermets are shown in Table VI.

TABLE VI

| $B_4C$ Content (vol %) | Toughness (MPa · $m^{\frac{1}{2}}$) |
|---|---|
| 55 | 11.6 |
| 60 | 8.9 |
| 65 | 7.2 |
| 70 | 6.4 |
| 75 | 6.2 |

The data presented in Table VI demonstrate that properties of $B_4C$—Al cermets prepared from heat treated $B_4C$ are very strongly affected by the amount (volume percent) of $B_4C$ present in the greenware prior to heat treatment and infiltration. As such, property comparisons should be made based upon similar materials, such as the same $B_4C$, the same greenware density, the same heat treatment profile, and the same infiltration time. Similar trends are expected at temperatures other than 1400° C., but within the ranges disclosed herein.

EXAMPLE 5

Compressive Stress Testing

Ceramic greenware pieces having a ceramic content of 70 volume percent were prepared by replicating the procedure of Example 1. The pieces were infiltrated with molten aluminum after heat treatment at 1300° C. or 1750° C. The resultant cermets were subjected to uniaxial compressive strength testing.

The uniaxial compressive strength was measured using the procedure described by C. A. Tracy in "A Compression Test for High Strength Ceramics", *Journal of Testing and Evaluation,* vol. 15, no. 1, pages 14–18 (1987). A bell-shaped (shape "B") compressive strength specimen having a gauge length of 0.70 inch (1.8 cm) and a diameter at its narrowest cross section of 0.40 inch (1.0 cm) was placed between tungsten carbide load blocks that were attached to two loading platens. The platens were parallel to within less than 0.0004 inch (0.0010 cm). The specimens were loaded to failure using a crosshead speed of 0.02 in/min (0.05 cm/min). The compressive strength was calculated by dividing the peak load at failure by the cross-sectional area of the specimen.

The compressive strengths of the cermets resulting from greenware baked at 1300° C. and 1750° C. were, respectively 3.40 GPa and 2.07 GPa.

This example shows that compressive strength decreases as a result of heat-treatment temperatures. The data demonstrate that temperatures between 1300° C. and 1750° C. constitute a transition zone for compressive strength. The data also suggest that an increased amount of metallic aluminum is present as temperatures increase within the transition zone.

EXAMPLE 6

Stepped-Stress Cyclic Fatigue Testing

Ceramic greenware pieces having a ceramic content of 68 volume percent were prepared by replicating the procedure of Example 1. The pieces were infiltrated with molten aluminum, as in Example 1, without prior heat treatment, after heat treatment at 1300° C. or 1750° C. or after sintering at 2200° C. The resultant cermets were subjected to stepped-stress cyclic fatigue testing.

The stepped-stress cyclic fatigue test was used to evaluate the ability of the materials to resist cyclic load conditions. Specimens measuring 0.25 inch (0.64 cm) in diameter by 0.75 inch (1.90 cm) long were cycled at 0.2 Hertz between a minimum ($\sigma_{min}$) and a maximum ($\sigma_{max}$) compressive stress of 15 and 150 ksi, respectively. If the specimen survived 200 cycles under this condition, $\sigma_{min}$ and $\sigma_{max}$ were increased to 20 and 200 ksi, respectively, and the test was continued for an additional 200 cycles. If the specimen survived 200 cycles under this condition, $\sigma_{min}$ and $\sigma_{max}$ were increased to 25 and 250 ksi, respectively, and the test was continued for an additional 600 cycles or until the specimen broke. If the specimen survived the additional 600 cycles, the test was stopped and the specimen was unloaded. If the specimen broke during testing, the maximum compressive stress and the total number of cycles aplied to the specimen before failure were reported. The results of testing specimens prepared from the cermet pieces are shown in Table VII.

TABLE VII

| Baking Temp °C. | $\sigma_{max}$ (ksi) | Number of Cycles |
|---|---|---|
| 1300 | 250 | >1000 |
| 1750 | 225 | 400 |

The data in Table VII demonstrate that resistance to cyclic fatigue decreases as baking or heat treatment temperatures increase. Baking at 1300° C. does, however, improve resistance to cyclic fatigue over that of a cermet prepared from $B_4C$ having no prior heat treatment.

EXAMPLE 7

A porous greenware preform was prepared as in Example 1 and baked for 30 minutes at 1300° C. A bar measuring 6 mm by 13 mm by 220 mm was machined from the preform. The bar was placed in a carbon crucible having aluminum metal disposed on its bottom. The crucible was then heated to 1160° C. at a rate of 8.5° C. per minute under a vacuum of 150 millitorr (20 Pa). The depth of metal penetration into the bar was measured at time intervals as shown in Table VIII.

TABLE VIII

| Time at 1160° C. (minutes) | Depth of Penetration (cm) |
|---|---|
| 1 | 2.0 |
| 10 | 7.2 |
| 20 | 9.7 |
| 40 | 12.2 |
| 105 | 19.0 |
| 120 | 21.0 |

Similar results are expected with baking or heat treatment temperatures greater than 1250° C. but less than 1800° C. Metal infiltration occurs more slowly and to a lesser extent in unbaked greenware or greenware given a heat treatment at a temperature of less than 1250° C. Heat treatment at temperatures in excess of 1800° C. do not produce further improvements in infiltration. Infiltration is believed to occur faster in a preform baked at temperatures of 1250° C. to less than 1800° C. than in a preform prepared from boron carbide that is chemically pretreated by, for example, washing with ethanol.

EXAMPLE 8

Boron carbide greenware materials were prepared as in Example 1 and baked at different temperatures and different lengths of time. After baking, the materials were infiltrated with aluminum metal as in Example 1 save for reducing the temperature to 1160° C. and the infiltration time to 30 minutes.

Bulk hardness of the infiltrated materials, measured as in Example 1, is shown in Table IX together with baking time and temperature.

TABLE IX

| Temperature (°C.) | Hardness (kg/mm²) Baking Time (hours) 0.5 | 1 | 2 | 5 |
|---|---|---|---|---|
| 1300 | 1071 | 1121 | 938 | 900 |
| 1400 | 721 | 700 | 705 | 681 |
| 1600 | 705 | 696 | 717 | 709 |

The data shown in Table IX demonstrate that hardness values tend to decrease with increased temperature, increased baking time or both. The data at 1400° C. and 1600° C. are quite similar. This suggests the existence of a transition zone between 1250° C. and 1400° C. wherein small changes in time, temperature or both may cause large changes in chemistry as reflected by variations in physical properties such as hardness. A comparison of the data shown in Tables V and IX suggests that greenware $B_4C$ content, $B_4C$ particle size distribution and infiltration time also influence hardness.

The data presented in Examples 1–8 demonstrate that heat treatment prior to infiltration at temperatures within the range of 1250° C. to less than 1800° C. provides at least two benefits. First, it enhances the speed and completeness of infiltration. Second, it allows selection and tailoring of physical properties. The changes in physical properties are believed to be a reflection of changes in microstructure.

What is claimed is:

1. A method for making a boron carbide/aluminum composite comprising sequential steps:

a) heating a porous boron carbide preform in an environment that is devoid of added free carbon to a temperature within a range of from 1250° C. to less than 1800° C. for a period of time sufficient to reduce reactivity of the boron carbide with molten aluminum; and b) infiltrating molten aluminum into the heated boron carbide preform, thereby forming a boron carbide/aluminum composite.

2. The method of claim 1 wherein the heated preform is subjected to shaping operations prior to step b).

3. The method of claim 1 wherein the temperature is from 1250° C. to less than 1350° C. and the composite has a microstructure characterized by a discontinuous boron carbide phase surrounded by clusters of reaction products, the reaction products being present in an amount that is from about 3 to about 10 percent by volume less than the amount of reaction products present in a composite prepared from a substantially identical, but unheated porous boron carbide preform.

4. The method of claim 1 wherein the temperature is from 1350° C. to less than 1450° C. and the composite has a microstructure characterized by a continuous metal phase, a discontinuous boron carbide phase and an aluminum phase concentration of more than about 10% by weight, based upon total composite weight.

5. The method of claim 1 wherein the temperature is from about 1450° C. to less than 1600° C., the composite has a microstructure characterized by boron carbide grains that are isolated or weakly bonded and surrounded by aluminum metal, and the composite has a greater metal content than that of a composite prepared from an unheated, but substantially identical porous precursor.

6. The method of claim 1 wherein the temperature is from about 1600° C. to less than 1800° C., the composite has a microstructure characterized by partially continuous boron carbide skeleton with uniformly distributed $Al_4BC$ reaction products that are in the form of elongated cigar-shaped clusters and aluminum metal.

7. The method of claim 1 wherein the composite has a concentration of $Al_4C_3$ of less than about 1% by weight, based upon total composite weight.

8. The method of claim 1 wherein the baking time and temperature are from 2 hours or more at 1300° C. to from about 0.5 hour to about 2 hours at 1400° C. and the composite has a microstructure characterized by $Al_4BC$ grains having an average diameter of less than about 5 μm.

* * * * *

UNITED STATES PATENT AND TRADEMARK OFFICE

CERTIFICATE OF CORRECTION

PATENT NO. : 5,394,929

DATED : March 7, 1995

INVENTOR(S) : Aleksander J. Pyzik, et. al.

It is certified that error appears in the above-indentified patent and that said Letters Patent is hereby corrected as shown below:

Title page, item [54] and col. 1, line 2, change "CARBIE" to read--"CARBIDE";--

Title page, item [75], Inventors: change "Dniel" to read--"Daniel"--.

Signed and Sealed this

Twenty-fourth Day of September, 1996

*Attest:*

Bruce Lehman

BRUCE LEHMAN

*Attesting Officer*

*Commissioner of Patents and Trademarks*